United States Patent [19]

Griffith

[11] 4,196,756

[45] Apr. 8, 1980

[54] LOOM SHUTTLE AND BEAT-UP MECHANISM

[75] Inventor: John D. Griffith, Cleadon, England

[73] Assignee: Bonas Machine Company Limited, Sunderland, England

[21] Appl. No.: 908,083

[22] Filed: May 22, 1978

[30] Foreign Application Priority Data

May 25, 1977 [GB] United Kingdom ..... 21992/77

[51] Int. Cl.[2] ..... D03D 47/26

[52] U.S. Cl. ..... 139/436

[58] Field of Search ..... 139/13 R, 13 A, 14, 139/16, 436

[56] References Cited

U.S. PATENT DOCUMENTS

| | | | |
|---|---|---|---|
| 1,947,976 | 2/1934 | Dickie et al. | 139/13 R |
| 2,101,022 | 12/1937 | Hale et al. | 139/13 R |
| 3,766,950 | 10/1973 | Vasek et al. | 139/436 |

FOREIGN PATENT DOCUMENTS

| | | | |
|---|---|---|---|
| 748195 | 10/1944 | Fed. Rep. of Germany | 139/13 R |
| 1055884 | 10/1953 | France | 139/13 R |

*Primary Examiner*—Henry Jaudon

*Attorney, Agent, or Firm*—James E. Nilles

[57] ABSTRACT

The invention provides a loom shuttle and beat-up device including rotary means for driving the shuttle and beat-up. In one case the same rotary element serves to drive the shuttle and beat-up the weft, in an alternative two elements are used, one to drive the shuttle and the other to beat-up the weft.

8 Claims, 10 Drawing Figures

LOOM SHUTTLE AND BEAT-UP MECHANISM

This invention concerns a loom shuttle drive and beat-up mechanism and method of operation. The invention is primarily although not exclusively, applicable to a travelling wave shedding loom.

An object of the present invention is to provide a relatively simple apparatus for controlling the shuttle movement and for causing beat-up of inserted weft.

A further object of the present invention is to provide a comparatively simple method of controlling shuttle movement and beat-up. Thus according to one aspect of the present invention a loom shuttle movement and/or beat-up mechanism includes at least one rotary element having a plurality of radially outwardly projecting members thereon, and at least one shuttle for inserting weft into a warp shed, said element being adapted to be moved transversely of a loom during rotation about an axis inclined relative to the transverse axis of the loom, whereby movement may be imparted to a shuttle and/or to a weft to be inserted into a shed to cause weft insertion and/or beat-up.

According to a further aspect of the present invention a method of driving a loom shuttle to cause weft insertion and beat-up includes the steps of traversing a shuttle through a warp shed by means of a rotary element operably associated with the shuttle, withdrawing weft yarn from the shuttle as it traverses the shed with the rotary element and beating-up the withdrawn weft yarn by means of shuttle driving outwardly projecting formations of the rotary element.

According to a still further aspect of the present invention a method of driving a loom shuttle to cause weft insertion and beat-up includes the steps of traversing a shuttle through a warp shed by means of a first rotary element operably associated with the shuttle, withdrawing weft from the shuttle as it traverses the shed with the rotary element, traversing a second rotary element through the warp shed and beating-up the withdrawn weft by means of outwardly projecting formations of the second rotary element.

The invention will now be described further, by way of example only, with reference to the accompanying schematic drawings in which.

DESCRIPTION OF THE INVENTION

In the following description reference is made to a shuttle driving and beat-up mechanism suitable for use in a travelling wave shedding loom but it should be appreciated that this is not intended to restrict the invention to use in this type of loom.

Figure 1:
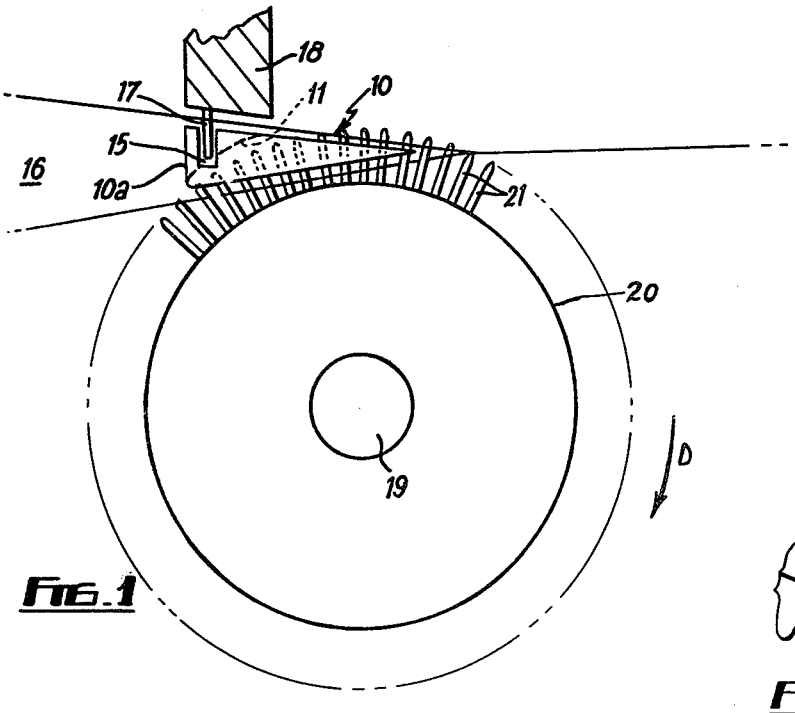
FIG. 1 is a side elevation of one form of shuttle driving and weft beat-up mechanism.
Figure 2:
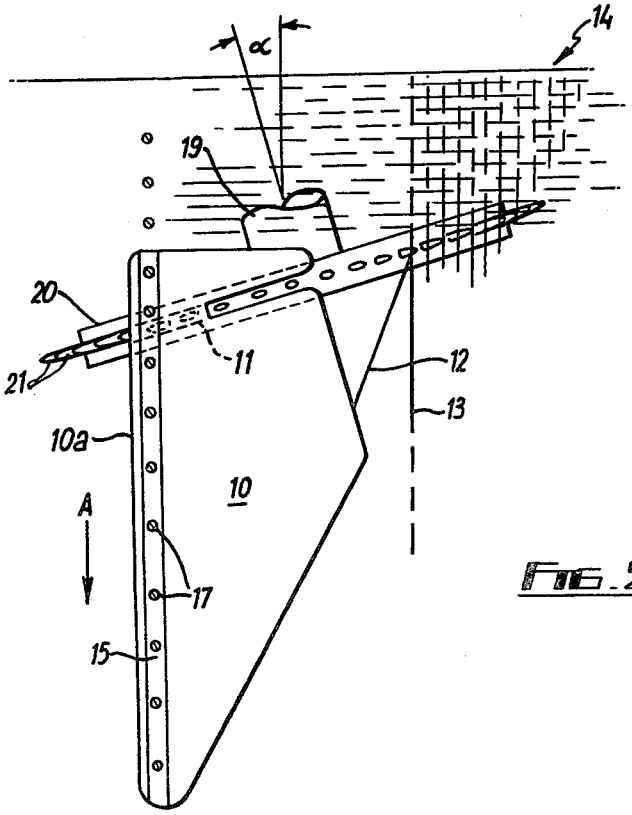
FIG. 2 is a plan view of the apparatus shown in FIG. 1.

As shown in FIGS. 1 and 2 there is provided a shuttle 10 adapted to contain a quantity of weft in a random manner. The shuttle is conveniently constructed in the form disclosed in our co-pending application U.S. Ser. No. 907,957 filed May 22, 1978 in so far as the weft receiving chamber is concerned. The shuttle 10 has, adjacent what, in use, is its trailing end, a slot 11 formed therein, this slot being inclined relative to the longitudinal axis of the shuttle. The slot 11 extends through part only of the depth of the shuttle 10 at the side 10*a* remote from that at which a weft thread 12 extends to the fell 13 of a fabric 14 being woven (see FIG. 2). The slot 11 extends completely through the shuttle 10 from a point intermediate its sides to the side from which the weft 12 passes to the fell 13 of the fabric 14.

Conveniently the shuttle is provided with a groove 15 extending from end to end of the shuttle parallel to and adjacent its side 10*a*. The purpose of the groove 15 is to enable the shuttle to be guided across the warp shed 16 by means of a row of guide pegs 17 carried by a fixed beam 18 of the loom.

Below the shuttle and carried on a rotatable shaft 19 is a shuttle drive element 20 in the form of a disc having radially outwardly extending drive pins 21 around its periphery. The disc is rotated, in use, in the direction of arrow D. The drive pins 21 engage in the slot 11 of the shuttle 10.

Figure 5:
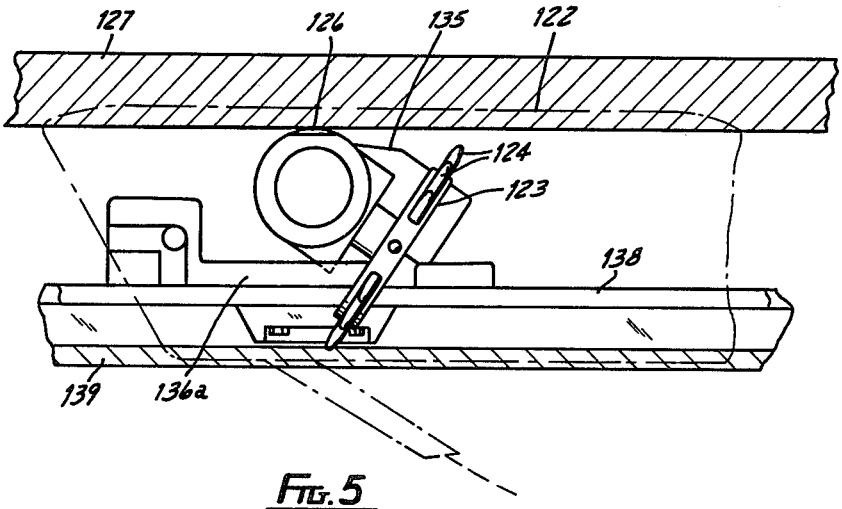
FIG. 5 is a plan view of an alternative embodiment.
Figure 6:
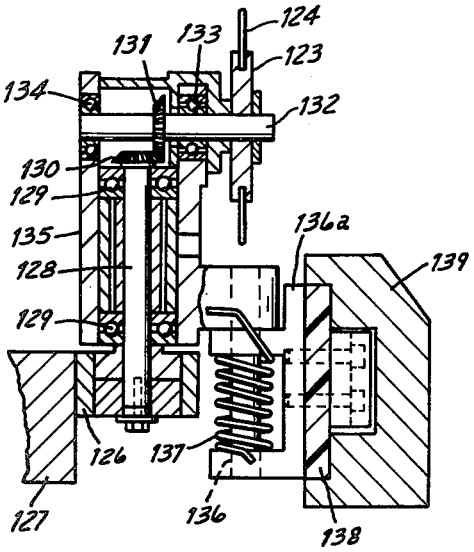
FIG. 6 is a sectional elevation of the drive of FIG. 5.
Figure 7:
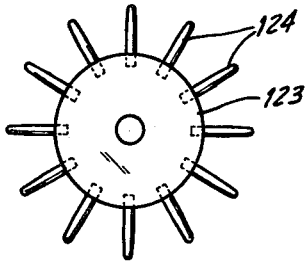
FIG. 7 is an elevation of part of the device of FIGS. 5 and 6.
Figure 7A:
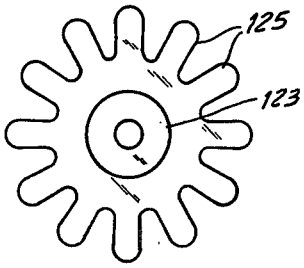
FIG. 7A is an alternative form of the part of FIG. 7.
Figure 8:
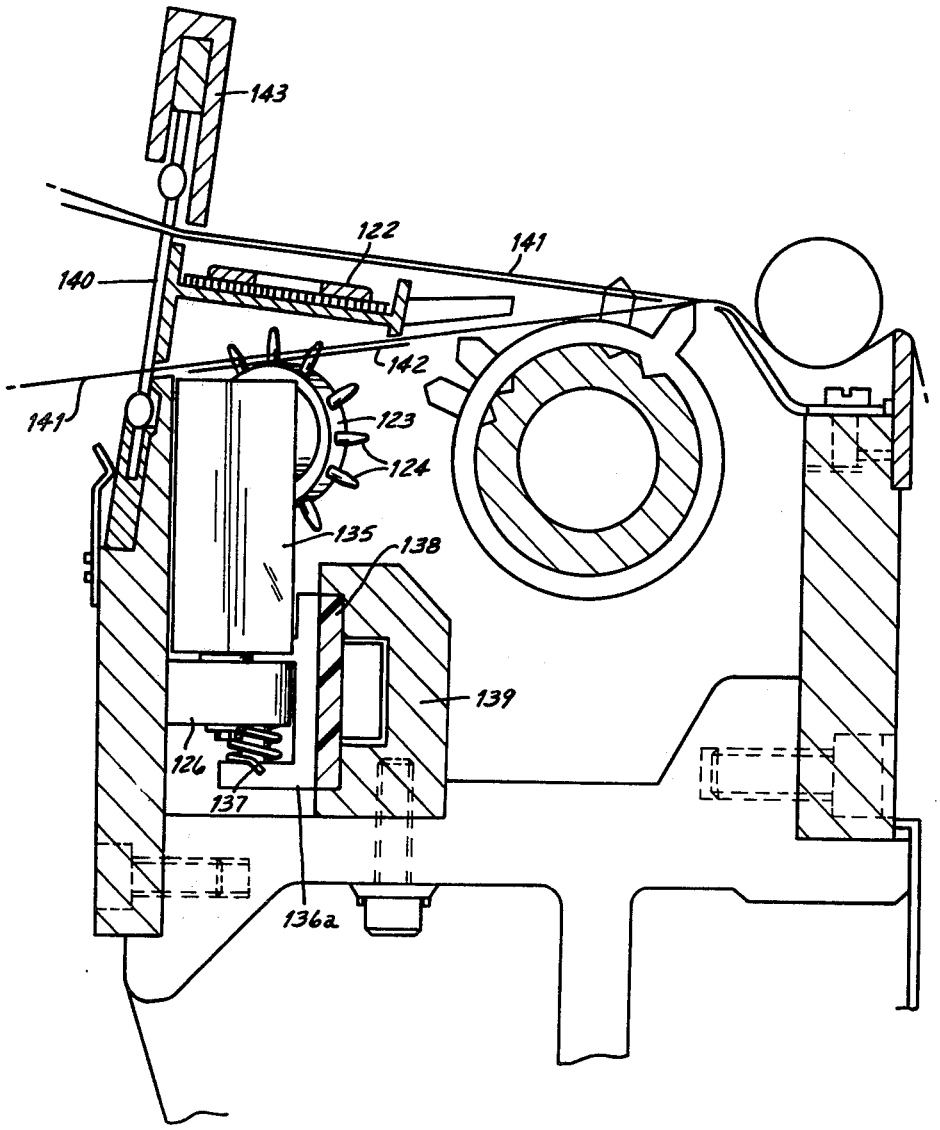
FIG. 8 is an end elevation of the device.

As can be seen from FIG. 2 the shaft 19 is disposed angularly relative to the transverse axis of the loom and the angle $\alpha$ between the transverse axis of the loom and the axis of rotation of the shaft is so chosen that as the disc 20 rotates the shuttle is driven, in the direction of arrow A, by the interengagement of the pins 21 in the slot 11, at the requisite speed through the warp shed 16. The shaft 19, and consequently the disc 20, moves across the loom as the disc 20 drives the shuttle 10 and the weft 12 withdrawn from the shuttle 10 is beaten up into the fell 13 of the fabric 14 by the pins 21 as they successively pass through the warp shed 16 at its junction with the fabric 14. The pins 21 thus serve the dual purpose of driving the shuttle 10 and beating-up the weft 12. By correctly choosing the angle $\alpha$ and the speed at which the shuttle 10 is driven the pins 21 are caused to pass between adjacent warp yarns with minimal disturbance of these yarns. It is to be understood that shaft 19 is provided with a suitable structure whereby it is physically supported and rotatably driven and, for example, such structure may be similar to that shown and described in FIG. 5 hereafter described. Furthermore, it is to be understood that means are provided to move the shaft 19 and its disc 20 across the loom in the direction of arrow A (FIG. 2) and such means may also take the form of the means shown in FIGS. 5 and 6, for example.

Figure 1A:
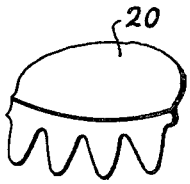
FIG. 1A is a modification to the periphery of the disc shown in FIG. 1.

As shown in FIG. 1A. the periphery of disc 20 may be formed somewhat to resemble a gear wheel instead of providing the pins 21 shown in FIG. 1.

Figure 3:
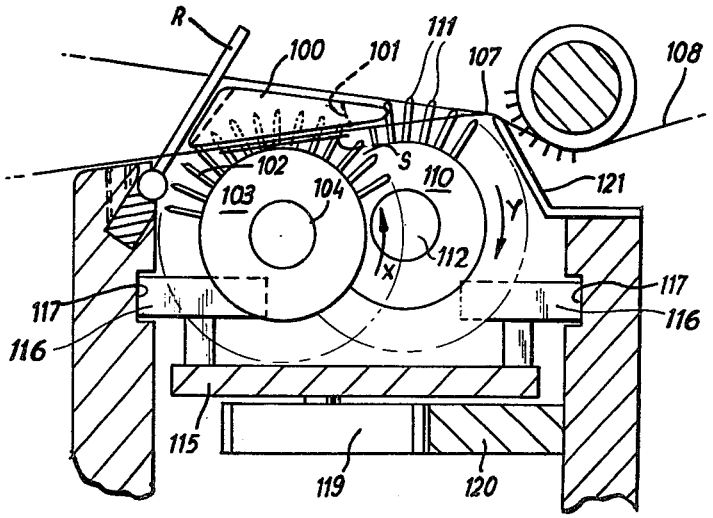
FIG. 3 is a view similar to FIG. 1 showing a modification.
Figure 4:
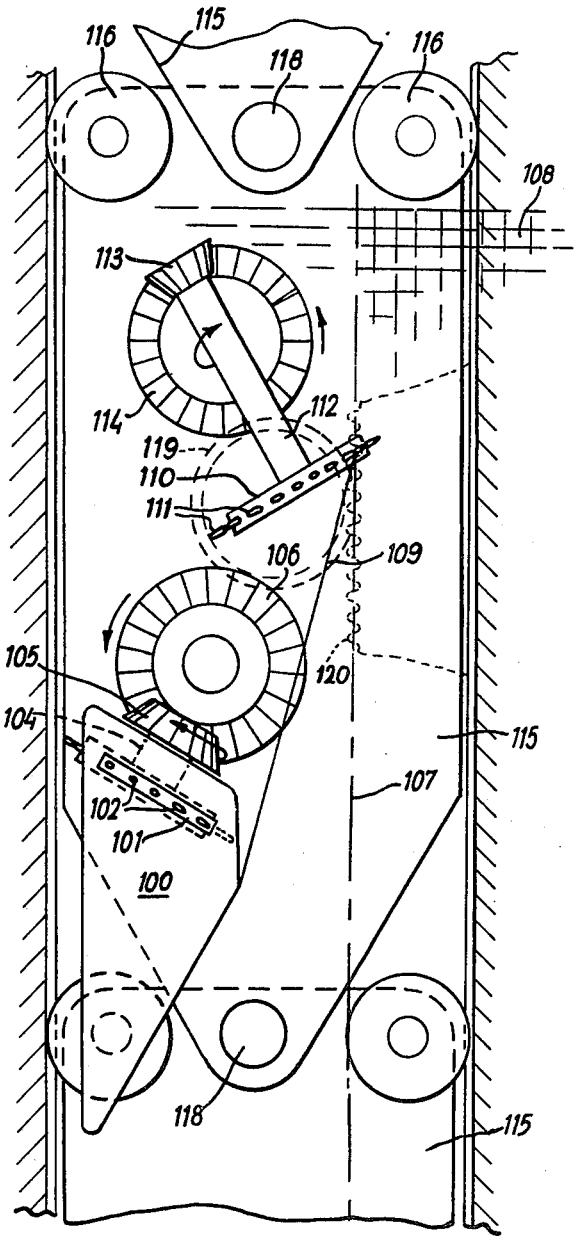
FIG. 4 is a plan view of the apparatus of FIG. 3.

With reference to FIGS. 3 and 4 which illustrate a modification of the apparatus just described it will be seen that the shuttle 100 is of similar form to that shown in FIGS. 1 and 2 in that it is provided with a slot 101 into which project pins 102 of a drive disc 103. While the form of the slot is somewhat different to that of the shuttle 10 of FIGS. 1 and 2 it will be appreciated that an identical slot could be provided if desired. The disc 103 is mounted at one end of a stub shaft 104 at the other end of which is provided a gear wheel 105 which meshes with a drive pinion 106. The direction of rotation of the disc 103 is indicated by the arrow X (see FIG. 3) and thus as the shuttle 100 is driven through the shed 116 the pins 102 of the disc 103 tend to push it away from the fell 107 of a fabric 108 being woven and towards a forwardly, upwardly inclined fixed reed R. The reed R serves to guide the shuttle 100 through the warp shed 116. Below the shuttle 100 and mounted on a trolley 115 (yet to be described) is an upwardly inclined shuttle plate S, this plate being located below the warp yarns of the lower part of the shed and defining, with the reed R, a generally V-shaped space in which the shuttle 100 moves. The reed R, due to its inclination prevents the shuttle 100 from moving upwardly relative to the plate S in addition to serving as a shuttle guide extending across the loom.

In this arrangement the pins 102 of the disc 103 serve only to drive the shuttle 100 and to achieve beat-up of a weft yarn 109 a second disc 110 having radially outwardly projecting pins 111 is provided. This disc 110 is carried by a shaft 112 which is provided with a drive gear 113 meshing with a drive pinion 114. As can be seen from FIG. 4. the shaft 112 is inclined relative to the transverse axis of the loom in such manner that as the disc rotates in the direction of arrow Y (see FIG. 3) the pins 111 beat-up the weft yarn 109 into the fell 107 of the fabric 108.

The pinions 106 and 114, discs 103 and 110 are mounted on a trolley 115 which carries rollers 116 arranged to run in grooves 117 in fixed parts of the loom. In a travelling wave shedding loom there are a series of such trolleys pivotally fixed to each other by pivot pins 118 thus rollers 116 are required at one end only of the trolleys 115.

Drive for the pinions 106, 114 is conveniently by means of a pinion 119 which is enmeshed with a rack 120 fixed to a loom frame member.

Forwardly of the fell 107 the fabric is passed over a guide fence 121 to take-up means not shown. In regard to FIGS. 3 and 4, it is to be understood that the shafts 104 and 112 may be rotatably supported and driven by a structure similar to that shown in FIG. 5.

In a still further alternative embodiment as shown in FIGS. 5 to 8 there is provided an arrangement in which as in the arrangement of FIGS. 1 to 3 the disc serves only to drive the shuttle. In this arrangement the shuttle 122 is driven by disc 123 which may either have pins 124 or blades 125 (see FIG. 7) around its periphery, as previously described. The disc is rotated by a tire 126 bearing against a stationary surface 127. It is to be understood that the stationary surface 127 is formed on a member which extends across the weaving area in the direction of shuttle movement. The tire is mounted on a spindle 128 mounted in bearings 129. At the other end of the spindle 128 is fixed a bevel gear 130. This gear drives a second bevel gear 131 which rotates the disc 123 via a spindle 132 mounted in bearings 133 and 134. The drive system is held in a housing 135 which is mounted on a pivot 136. The tire 126 is pressed against the surface 127 by a torsion spring 137 which acts out the pivot 136.

The pivot 136 is held in a bracket **136*a* which is attached to a belt 138. This belt pulls the assembly along and is guided in a guide block 139**.

The shuttle 122 is located by the reed 140 and warp yarns 141. The lower warp yarns are held in position by bearing against a strip 142 and the upper warp yarns by a removable reed cap 143.

While reference has been made to a travelling wave shedding loom it is possible to employ the shuttle drive means and beat-up means described above in a loom having conventional shed forming healds. It is also possible in a loom having conventional shed forming healds to employ the shuttle drive means described and to employ conventional weft beat-up means.

What we claim is:

1. A loom shuttle drive mechanism including at least one rotary element having a plurality of radially outwardly projecting members thereon and at least one shuttle for inserting weft into a warp shed, said element being adapted to be moved transversely of a loom during rotation about an axis inclined relative to the transverse axis of the loom, whereby movement may be imparted to a shuttle during its passage into a shed and across the warp to cause weft insertion.

2. A loom shuttle drive mechanism as claimed in claim 1 in which there is a single rotary element the outwardly projecting members thereof being so positioned as to make driving contact with a receiving formation in the shuttle thereby to drive same through a warp shed.

3. A loom shuttle drive mechanism as claimed in claim 1 in which the outwardly projecting members are radially disposed around the periphery of a rotary disc, said projecting members serving, in use, to drive the shuttle.

4. A loom shuttle drive mechanism as claimed in claim 1 in which there are a plurality of shuttles adapted successively to be driven through successive warp sheds formed in a travelling wave shedding loom.

5. A loom shuttle drive mechanism as claimed in claim 1 in which the projecting members are in the form of spaced-apart pins.

6. A loom shuttle drive mechanism as claimed in claim 1 in which the projecting members are substantially in the form of gear teeth.

7. A loom shuttle drive mechanism as claimed in claim 1 in which the rotary element is carried in a housing, the latter being pivotally mounted on a carrier member which latter is operably associated with a drive means adapted to draw the housing transversely across a loom.

8. The method of driving a loom shuttle to cause weft insertion including the steps of providing a tranversely movable rotary element, engaging the shuttle with said rotary element so as to traverse said shuttle through a warp shed, weft yarn being withdrawn from the shuttle as it traverses the shed with the rotary element and beating-up the withdrawn weft yarn by means of the shuttle driving rotary element.

* * * * *